US006062005A

United States Patent [19]

Roberts

[11] Patent Number: 6,062,005

[45] Date of Patent: May 16, 2000

[54] CONTROLLING HALTER FOR ANIMALS

[75] Inventor: Marvin E. Roberts, Solvang, Calif.

[73] Assignee: Monty & Pat Roberts, Inc., Bielton, Calif.

[21] Appl. No.: 09/329,617

[22] Filed: Jun. 10, 1999

Related U.S. Application Data

[60] Provisional application No. 60/088,889, Jun. 11, 1998.

[51] Int. Cl.[7] ..... B68B 1/02

[52] U.S. Cl. ..... 54/24

[58] Field of Search ..... 54/24, 6.2, 8.5; 119/831

[56] References Cited

U.S. PATENT DOCUMENTS

| | | | |
|---|---|---|---|
| 56,213 | 7/1866 | Haines . | |
| 153,006 | 7/1874 | Mathews . | |
| 200,720 | 2/1878 | Henkell . | |
| D. 335,726 | 5/1993 | Baker | D30/136 |
| 379,369 | 3/1888 | Covert | 54/24 |
| 506,475 | 10/1893 | Covert . | |
| 917,059 | 4/1909 | Hansen . | |
| 996,556 | 6/1911 | Billey . | |
| 1,183,974 | 5/1916 | Hintgen | 119/831 |
| 1,278,021 | 9/1918 | Robinson . | |
| 2,031,271 | 2/1936 | Lombella . | |
| 2,525,684 | 10/1950 | Kinskie | 119/831 |
| 2,961,816 | 11/1960 | Reed . | |
| 4,337,610 | 7/1982 | Taylor | 54/24 |
| 5,086,611 | 2/1992 | Purdy | 54/24 |

FOREIGN PATENT DOCUMENTS

| | | |
|---|---|---|
| 25066 | of 1897 | United Kingdom . |
| 94/14699 | 7/1994 | WIPO . |

*Primary Examiner*—Thomas Price
*Attorney, Agent, or Firm*—Fulbright & Jaworski, L.L.P.

[57] ABSTRACT

An animal control halter comprising flexible strapping to girdle the bridge of the animals nose connected to an underchin strap to form a loop around the animal's nose. A bridge strap can be positoned rearwardly of the nose strap. By connecting a lead to the nose strap or chin strap the animal can be respectively trained or tethered.

18 Claims, 1 Drawing Sheet

FIG. 1
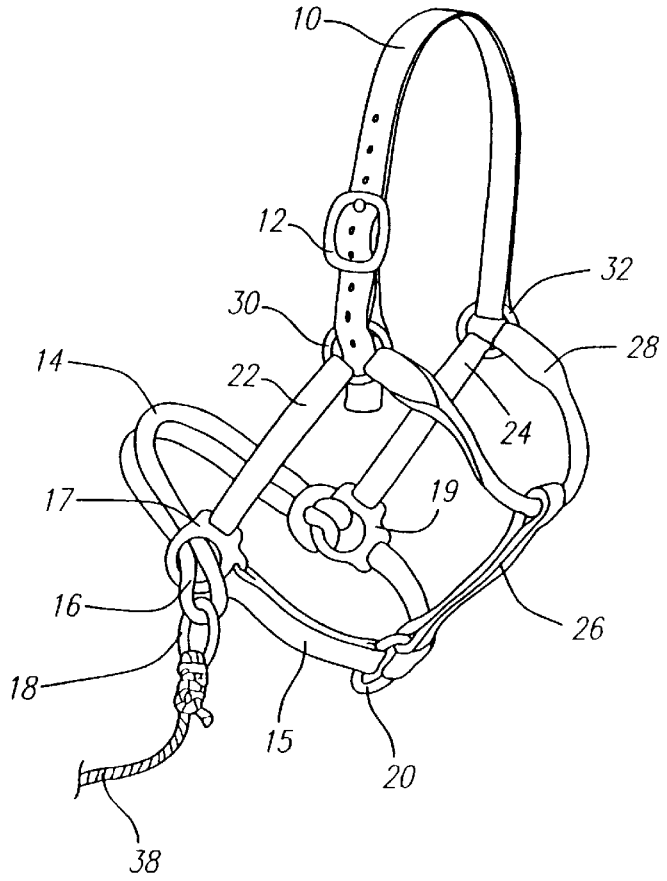
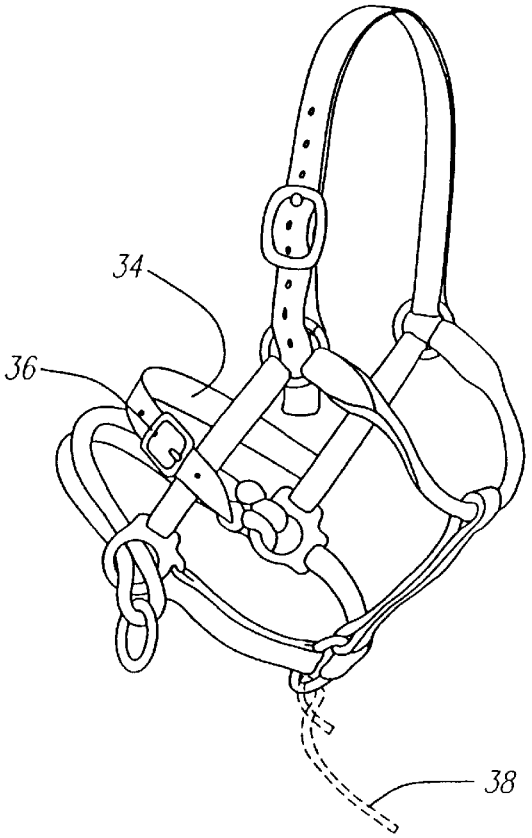
FIG. 2

CONTROLLING HALTER FOR ANIMALS

CROSS-REFERENCE WITH RELATED APPLICATIONS

This application claims the benefit of U.S. Provisional Application Ser. No. 60/088,889 filed Jun. 11, 1998.

BACKGROUND OF THE INVENTION

1. Field of the Invention

The invention relates generally to a halter for use in tethering or training an animal.

2. Description of Related Art

Halters are well known and have been in use for many years for a variety of useful purposes. They are usually made from leather, braided nylon, or other strong material that resists breaking, and are fitted securely over the head of an animal, such as a horse. When a lead rope is attached, the halter may be used for leading, tethering, or otherwise controlling the animal.

Taylor, U.S. Pat. No. 4,337,610, discloses a training or control halter having a rigid nose strap and a control rope which underlies the chin of the animal. Hintgen, U.S. Pat. No. 1,183,974, discloses a halter for cattle having a nose tightening chain and allows alternating between connecting a tie rope to the neck ring for use as a lead or connecting the control rope to a chain tightening ring for tightening the nose strap. Streatfeild, et al., World Patent W094/14699 discloses a head collar or harness coupling having a lead rope and a nose strap wherein the tensioning of the lead rope causes the coupling to tighten the nose strap of the harness. Wethered, British Patent No. 25,066, discloses a halter without a bit which uses a lever to tighten opposing top and bottom nose straps and also discloses a secondary nose strap rearwardly of the lever nose strap.

Conventional halters encircle the neck and muscle of an animal and are generally used by connecting the lead rope to the neck portion of the halter. It is advantageous to have a halter which can be used to restrain as well as to train an animal.

Training of the animal occurs by pulling on a lead rope attached to a nose strap of the halter. The pulling causes pressure to be applied by the nose strap to the animal's nose to clamp its' jaws. By utilizing this approach, the pressure which is created on the top portion of the nose of the animal whenever it undertakes an undesired movement is quickly associated by the animal with such movement and training to eliminate undesired movements is greatly facilitated.

Halters that utilize a nose strap that can be tightened for training purposes generally have straps that tighten under the jaw of the animal, which can cause the animal discomfort and pain. The animal's discomfort can lead to a loss of control of the animal by the trainer.

It would be highly advantageous to provide a halter for use in training and everyday tethering of an animal that in training enables control of the animal without excessive discomfort and pain.

BRIEF SUMMARY OF THE INVENTION

The present invention provides a halter that can be used for both tethering and training. When used for training, it does so by applying pressure to the bridge of the animal's nose without causing significant pain and discomfort under its chin. Therefore, it enables the animal to be trained with minimal distraction from instructions.

The halter comprises strapping to encircle an animal's head including a nose strap for girdling the bridge of the animal's nose, and an under chin strap. The nose strap is flexible and connected to the under chin strap to form a loop around the animal's nose. An end of the nose strap is moveable, with respect to the under chin strap, to ultimately tighten and expand the loop whereby tightening pressure can be applied to the bridge of the animal's nose with little direct tightening across the animal's chin. In a further embodiment, an adjustable bridge strap can be secured over the animal's nose bridge rearwardly of the nose strap to allow more comfort for the animal in training.

Constructionally, the halter comprises a neck strap connected to first and second cheek straps that extend from the neck strap toward the front of the animal's nose; first and second forward connectors attached, respectively, to the forward ends of the first and second cheek straps; a strap, attached between the first and second forward connectors, having a first lead rope connector therein at an intermediate point; a nose strap attached to said second forward connector, having an end forming a loop passing through the first forward connector; and a second lead rope connector enclosed within said loop of said nose strap.

In one embodiment of the invention, a lead rope is connected to the second lead rope connector. The pulling of the lead rope causes a tightening of the nose strap over the hard bridge of the nose of the animal. In another embodiment of the invention, the halter includes a bridge strap, positioned rearwardly from the nose strap and which girdles the bridge of the animal's nose but not the chin of the animal. The bridge strap provides for greater flexibility in fitting the halter to the animal's head and provides greater comfort to the animal during training.

The importance of a strong, flexible halter having a nose strap that can be tightened or loosened over the hard bridge or top portion of the nose of the animal, as opposed to under the jaw of the animal, which is soft when compared to the hard bridge of the nose, makes this halter amenable to training the animal. By also providing a lead rope connector under the jaw, the halter of the present invention is also amenable to conventional tethering of the animal.

These and other features, aspects, and advantages of the present invention will become better understood with regard to the following detailed description, appended claims, and accompanying drawings.

BRIEF DESCRIPTION OF THE DRAWINGS

FIG. 1 is a perspective view of a halter in accordance with a first embodiment of the present invention.

FIG. 2 is a perspective view of a halter constructed as in FIG. 1, but includes a bridge strap in accordance with a second embodiment of the invention.

DETAILED DESCRIPTION OF THE INVENTION

The halter of the present invention tended to be used with horses, but also can be readily adopted to other animals, such as dogs, cows, sheep, etc. The following description will be with respect to a horse. A halter in accordance with this invention is shown in FIG. 1. As used in this invention, "strong, flexible material" is meant to comprise material that includes leather, braided nylon, or other strong material. A pair of rear connectors 30 and 32, a pair of forward connectors 17 and 19, and a pair of lead rope connectors 20 and 18, are made of a strong, smooth, material, such as brass and are either entirely ring-shaped, as are connectors 30 and 32, or include strap slits, as do connectors 17 and 19.

In the embodiment of the present invention illustrated in FIG. 1, the halter is formed with a neck strap 10 which goes over the head of the animal behind its ears, and this cooperates with a throat latch 28. The neck strap 10 has means for adjusting its effective length such as a buckle 12. The neck strap 10 and the throat latch 28 are joined by the pair of connectors 30 and 32, which also have a pair of cheek straps 22 and 24 attached to them. The cheek straps 22 and 24 are located on opposite sides of the animal's head and extend from the connectors 30 and 32 toward the front part of the nose of the animal. The buckle 12 on the side of the neck strap 10 enables the halter to be adjusted for the heads of animals of different sizes, or for other animals.

A strap 26 also extends from the throat latch 28 toward the front portion of the halter where it is attached a first lead rope connector 20. The forward ends of the cheek straps 22 and 24 are attached to the forward connectors 17 and 19, respectively. These forward connectors secure an under jaw strap 15 that is attached between the first forward connector 17 and the second forward connector 19, and that passes through the first lead rope connector 20. A nose strap 14 goes over the top portion of the animals' nose and is attached to the second forward connector 19. The end 16 of the nose strap 14 passes through the first forward connector 17 and the end 16 is formed as a loop girdling the bridge of the horse's nose and enclosing a second lead rope connector 18. The nose strap 14 is flexible and, by the foregoing arrangement, when its' end 16 is pulled, it tightens on top of a horse's nose, without significant tightening under the horse's chin. By such means, pressure is applied to the bridge of the top portion of a horse's nose with little direct movement across, or tightening of, the horse's chin. This enables the horse to be more readily trained as it allows the horse to concentrate on tightening of the loop on top of its' nose without being distracted by pain and/or discomfort under its chin.

As illustrated in FIG. 2, a second embodiment of the present invention wherein the halter includes a bridge strap 34, positioned rearwardly from the nose strap 14. The bridge strap 34 has ends attached between the cheek strap 22 and the cheek strap 24, goes over the bridge of the animal's nose, and includes a buckle means 36 for adjusting its effective length. Preferably, the buckle means 36 is provided on the side of the bridge strap 34, whereby adjustment can be made for the growth of the animal or for heads of different sizes.

A lead rope 38 can be attached either to the first lead rope connector 18, as shown, or to the second lead rope connector 20, as shown in shadow in FIG. 2. When attached to the lead rope connector 20, a standard halter configuration is obtained, whereby the animal can be tied down. When attached to lead rope connector 18, a training halter configuration is obtained that can be used in the following manner.

It is recommended that the animal be trained in an enclosed space, on soft, non-slip footing, preferably 3 inches of sand. The halter is configured to train the animal to move forward when the halter is pulled. The halter should be used with pulling and pushing motions, not jerking motions. The trainer should attempt to pull the animal to himself or herself at angles, and not straight ahead. Any pressure on the halter should be released if the animal reverses in such a way so as to endanger itself. Pressure is reapplied only after the animal has stopped reversing. Rewarding the animal is a very important aspect when using the halter for training purposes. The animal should be rewarded by the trainer standing squarely in front of it with slack in the lead line and rubbing between the eyes.

Slack in the lead line should be allowed when the animal chooses to come forward, and the trainer should not continue to pull. When the animal chooses to come to the trainer, it should be rubbed and congratulated with slack in the lead line. After the animal comes forward willingly, train it to back up willingly with the halter as well. Reward the animal for moving backward as it was rewarded for moving forward.

Plenty of time should be taken to train the animal, and training should finish when the animal is extremely responsive to requests to move forward and backward. The animal should walk freely with its' nose at the trainer's shoulder, and stop willingly when the trainer stops, and should back up willingly if the trainer backs up after stopping.

The dual-purpose halter is useful in training or in the day-to-day handling of the animal. It is extremely effective for training the animal to lead, to stand still, to walk into a truck or trailer, to walk slowly through narrow passages, to walk over unfamiliar objects, and other tasks that the trainer cannot devise. The halter is also useful in the conventional tethering of the animal by providing a lead rope connector under the jaw of the animal.

Although the foregoing invention has been described in some detail by way of illustration for purposes of clarity and understanding, various modifications and changes which are within the knowledge of those skilled in the art are considered to fall within the scope of the appended claims.

I claim:

1. An animal control halter comprising:

strapping to encircle an animal's head including a nose strap for girdling the bridge of the animal's nose, and an under chin strap, said nose strap being flexible and connected to said under chin strap to form a loop around the animal's nose, an end of the nose strap being moveable with respect to the under chin strap to alternately tighten and expand said loop whereby when the end of said nose strap is pulled, pressure is applied downwardly on the bridge of the animal's nose with little direct tightening across the animal's chin.

2. The halter of claim 1 in which one end of said nose strap is fixedly connected to said under chin strap.

3. The halter of claim 1 including a pair of straps disposed to be on opposite sides of the animals head and to extend along its' cheeks and nose, and including an adjustable bridge strap fixedly secured at opposite ends to respective cheek straps to overlie the animal's nose bridge and to be positioned rearwardly from said nose strap.

4. An animal control halter comprising:

a neck strap connected to a first and second cheek straps extending therefrom toward the front of the animal's nose;

first and second forward connectors attached, respectively, to the forward ends of said first and second cheek straps;

a strap, attached between said first and second forward connectors, having a first lead connector therein at an intermediate point; and a nose strap attached to said second forward connector, having an end forming a loop passing through said first forward connector, whereby the tightening of said nose strap is over the hard bridge of the nose of the animal.

5. The halter of claim 4 further comprising a second lead rope connector enclosed within said loop of said nose strap whereby to connect a lead rope.

6. An animal control halter comprising:

a neck strap connected to a first and second cheek straps extending therefrom toward the front of the animal's nose;

first and second forward connectors attached, respectively, to the forward ends of said first and second cheek straps;

a strap, attached between said first and second forward connectors, having a first lead connector therein at an intermediate point;

a nose strap attached to said second forward connector, having an end forming a loop passing through said first forward connector; and a second lead rope connector enclosed within said loop of said nose strap whereby the tightening, of said nose strap by a lead rope attached to said second lead rope connector, is over the hard bridge of the nose of the animal.

7. The halter of claim 6, further comprising a bridge strap positioned rearwardly from said nose strap, having ends attached between said first and second cheek straps.

8. The halter of claim 7, wherein said bridge strap comprises means for adjusting its effective length.

9. The halter of claim 6, wherein said nose strap comprises a plurality of strands.

10. The halter of claim 6, wherein said nose strap comprises a strap made of nylon.

11. The halter of claim 10, wherein said nylon is braided.

12. An animal control hater comprising:

strapping to encircle an animals head including a nose strap girdling the bridge of the animal's nose and an under chin strap to which the girdling strapping is connected, to form a tightenable loop around the animals nose;

a pair of straps disposed to be on opposite sides of the animals head and to extend along its cheeks and nose; and an adjustable bridge strap fixedly secured at opposite ends to respective cheek straps to overlie the animals nose bridge and position rearwardly from said nose strap.

13. An animal control halter comprising:

a neck strap connected to a first and second cheek straps extending therefrom toward the front of the animal's nose;

first and second forward connectors attached, respectively, to the forward ends of said first and second cheek straps;

a strap, attached between said first and second forward connectors, having a first lead connector therein at an intermediate point;

a nose strap attached to said second forward connector, having an end forming a loop passing through said first forward connector; and a bridge strap positioned rearwardly from said nose strap, having ends attached between said first and second cheek straps.

14. The halter of claim 13, further comprising a second lead rope connector enclosed within said loop of said nose strap.

15. The halter of claim 13, wherein said bridge strap comprises means for adjusting its effective length.

16. The halter of claim 13, wherein said nose strap comprises a plurality of strands.

17. The halter of claim 13, wherein said nose strap comprises a strap made of nylon.

18. The halter of claim 17, wherein said nylon is braided.

* * * * *